US006679491B2

(12) United States Patent
Luebben et al.

(10) Patent No.: US 6,679,491 B2
(45) Date of Patent: Jan. 20, 2004

(54) MAIL PIECE FEEDER CONTROL SYSTEM AND METHOD

(75) Inventors: Hauke Luebben, Radolfzell (DE); Jochen Loose, Irving, TX (US); Daniel Kang, Irving, TX (US); Michael Allain, Coppell, TX (US); Michael Yaklin, Coppell, TX (US)

(73) Assignee: Siemens Aktiengesellschaft, Munich (DE)

( * ) Notice: Subject to any disclaimer, the term of this patent is extended or adjusted under 35 U.S.C. 154(b) by 63 days.

(21) Appl. No.: 09/954,482

(22) Filed: Sep. 17, 2001

(65) Prior Publication Data

US 2003/0052444 A1 Mar. 20, 2003

(51) Int. Cl.[7] ..... B65H 1/18
(52) U.S. Cl. ..... 271/150
(58) Field of Search ..... 271/128, 129, 271/130, 150, 153, 155, 31.1, 235

(56) References Cited

U.S. PATENT DOCUMENTS

| | | | | |
|---|---|---|---|---|
| 3,845,852 A | | 11/1974 | Langen et al. | 198/34 |
| 4,167,227 A | | 9/1979 | Pichon et al. | 198/456 |
| 4,333,297 A | | 6/1982 | Kuttenbaum et al. | 53/252 |
| 5,893,701 A | | 4/1999 | Pruett | 414/798.2 |
| 5,947,468 A | | 9/1999 | McKee et al. | 271/210 |
| 6,026,967 A | * | 2/2000 | Isaacs et al. | 209/539 |
| 6,260,841 B1 | * | 7/2001 | Tranquilla | 271/127 |
| 6,511,062 B1 | * | 1/2003 | Blackwell et al. | 271/153 |

* cited by examiner

*Primary Examiner*—Donald P. Walsh
*Assistant Examiner*—Kenneth W Bower
(74) *Attorney, Agent, or Firm*—Philip G. Meyers

(57) ABSTRACT

A method of singulating and feeding a random mix of thick and thin flat articles includes: (a) sensing whether a flat article is positioned on a feed conveyor in a position for removal from the feeder conveyor with a sensor, (b) advancing the feed conveyor with a first motor an incremental step to place a series of flat articles positioned on edge in a position for removal from the feed conveyor each time the sensor detects the absence of a flat article for removal from the feed conveyor, (c) counting each incremental advance of the feed conveyor, (d) incrementally advancing the stack of flat articles with a jogger driven by a second motor after the feed conveyor has moved a predetermined number of incremental steps to load additional flat articles on the feed conveyor, the jogger tending to edge the flat articles for removal from the feed conveyor; and (e) repeating steps (a)–(d) while sequentially removing flat articles from the feed conveyor on a one-by-one basis as the feed conveyor is advanced. The method is implemented with a feeder comprising a belt type feeder conveyor, a chain driven, finger type jogger and a belt type entry conveyor where the flat articles and/or mail pieces are loaded edgewise.

22 Claims, 8 Drawing Sheets

MAIL PIECE FEEDER CONTROL SYSTEM AND METHOD

TECHNICAL FIELD

The present invention relates to an apparatus, system and method of feeding flat articles to a sorter, and in particular, feeding mail items to an automated mail processing machine such as a mail sorter.

BACKGROUND OF THE INVENTION

Modern postal services, for example, the U.S. Postal Service, handle massive volumes of mail pieces on a daily basis. Machines for receiving and sorting these massive volumes of letter mail are known. Typically, such machines are adapted to receive large volumes of flat articles and sort the articles into a plurality of pockets or bins based upon selected criteria. In the case of letter mail, the criteria is associated with the destination of the individual mail pieces which may be an indicia such as a Zip+4 destination code. Typically, such sorting machines have a feeding station, sensing and detecting equipment for determining the appropriate output compartment or pocket for the article to be sorted and diverting gates or other mechanisms for selectively diverting articles to selected ones of an array of output compartments or pockets for the sorted articles. An example of an advanced sorting machine is the DBCS sorting device, available from Siemens ElectroCom, L.P., Arlington, Tex.

Devices for singulating and feeding mail pieces to a sorting machine are known. One such apparatus is disclosed in U.S. Pat. No. 5,947,468, the disclosure of which is incorporated by reference for all purposes. Such devices however, do not meet all the existing needs in terms of processing different types of flat articles. Ideally, the feeder/singulator of a mail sorting machine as described above would have the capability of handling stacks of flat articles of varying thickness while maximizing throughput. However, feeding and singulating a stack of flat articles including thin flat items such as letters, and thicker packages such as packaged catalogues, for example up to ½ inch, presents a number of difficulties. For example, when thick flat articles are fed one-by-one from a stack of flat articles, the volume of the stack is reduced rapidly. Conversely, when thin, flat articles are fed, the volume of the stack is reduced at a much slower rate. Existing feeder/singulation methods and apparatus do not provide for feeding a stack of flat articles having varying thicknesses, such as mail pieces, while simultaneously maximizing throughput. The present invention addresses this drawback.

SUMMARY OF THE INVENTION

In one aspect, the invention comprises a method of singulating and feeding a random mix of thick and thin flat articles including: (a) sensing whether a flat article is positioned on a feed conveyor in a position for removal from the feeder conveyor with a sensor, (b) advancing the feed conveyor an incremental step with a first motor to place a series of flat articles positioned on edge in a position for removal from the feed conveyor each time the sensor detects the absence of a flat article for removal from the feed conveyor, (c) counting each incremental advance of the feed conveyor, (d) incrementally advancing the stack of flat articles with a jogger driven by a second motor after the feed conveyor has moved a predetermined number of incremental steps to load additional flat articles on the feed conveyor, the jogger tending to edge the flat articles for removal from the feed conveyor; and (e) repeating steps (a)–(d) while sequentially removing flat articles from the feed conveyor on a one-by-one basis as the feed conveyor is advanced. The method is implemented with a feeder comprising a belt type feeder conveyor, a chain driven, finger type jogger and a belt type staging conveyor where the flat articles and/or mail pieces are loaded edgewise. The stack of mail pieces is advanced from the staging conveyor to the jogger and then to the feed conveyor from which the flat articles are removed with a take off device, such as a vacuum assisted belt conveyor oriented perpendicular to the feed conveyor. The staging conveyor, jogger and feed conveyor are each provided with a separate drive motor, allowing each to be controlled independently and operated at a different speed, which in turn allows dynamic control of the feeder system. The jogger motor is energized after the feed conveyor motor turns a predetermined number, for example 6–8 "ticks" i.e., rotations or fractional rotations of the motor that are registered and counted with an internal clock like sensor. The number of ticks required to activate the jogger will depend upon the particular design of the feeder system, including the relative linear velocities of feeder conveyor 16 and jogger 16, the spacing of the jogger fingers and other criteria specific to a particular application. After the jogger is activated, it advances until a jogger finger sensor detects a jogger finger moving into proximity to a jogger finger sensor at which time the jogger motor is deactivated, stopping the jogger.

In this aspect, the method includes loading the staging conveyor with flat articles and incrementally advancing the stack with the staging conveyor to load additional flat articles on the jogger after the feed conveyor has moved a predetermined number of incremental steps. When the staging conveyor is loaded, a paddle is placed at the end of the stack to hold the stack as it is carried to the jogger. The staging conveyor is preferably provided with a series of centrally positioned perforations or holes that extend the length of the conveyor into which a tab or projection of the paddle is inserted so the staging conveyor carries the paddle as it advances. The feeder is also equipped with one or more paddle sensors which detect the paddle as it moves to different locations such as a staging paddle sensor that senses the paddle as it approaches the end of the staging conveyor and signals the feeder controller to deactivate the unit until the staging is reloaded with addition flat articles.

In another aspect, the jogger imparts a bouncing motion to the stack of articles as it carries the articles to the feed conveyor. The bouncing motion is imparted with one or more shafts having at least one flattened surface that rotate between the fingers of the jogger. The bouncing motion of the jogger tends to separate and edge or align the flat articles vertically and horizontally as the articles are conveyed. Stack separation fingers, driven by the jogger create temporary gaps in the stack as the stack is conveyed from the staging conveyor to the jogger. The separation fingers are preferably actuated with a rotary cam driven by the jogger, however, the operation of the separation fingers could be initiated with a sensor or timer depending upon the particular design and application.

In yet another aspect, according to the invention, a feeder for a mail sorter includes a controller, a horizontal entry belt conveyor, a jogger which receives a stack of mail from the entry conveyor on edge and aligns the stack as it passes through the jogger and a horizontal feeder belt conveyor that receives the stack in increments from the jogger. An upright take off mechanism at an end of the feeder conveyor opposite the jogger sequentially removes the frontmost mail piece from the stack, conveying each piece sideways and feeding a singulated stream of mail pieces to the mail sorter. A repositionable paddle mounted on a rail above the conveyors and jogger supports a rear end of the stack of mail pieces as it moves through the feeder. A plurality of paddle sensors each signal the controller when the paddle is in proximity of the sensor. In particular a paddle sensor positioned adjacent to the end of the entry conveyor signals the controller to shut the feeder down when the paddle reaches the sensor.

Operation of the feed conveyor is controlled with a switch positioned adjacent to the take off device that determines when a frontmost mail piece is in sufficient engagement with the take off mechanism for the take off mechanism to remove the frontmost mail piece from a stack of mail. When a mail piece is not present, the feed conveyor motor is cyclically advanced in increments until the foremost mail piece is detected. A sensor or switch associated with the feeder conveyor motor signals the controller that counts each incremental advance of the feeder conveyor and incrementally advances the jogger to feed additional mail pieces onto the feeder conveyor when a predetermined number of incremental advances of the feeder conveyor has occurred. In a preferred embodiment, the take off mechanism comprises a vertical belt type conveyor and a jogger sensor is provided for detecting an incremental movement of the jogger.

BRIEF DESCRIPTION OF THE DRAWINGS

These and other aspects of the invention will hereafter be described with reference to the accompanying drawings, wherein like numerals denote like elements, and.

DETAILED DESCRIPTION

Figure 1:
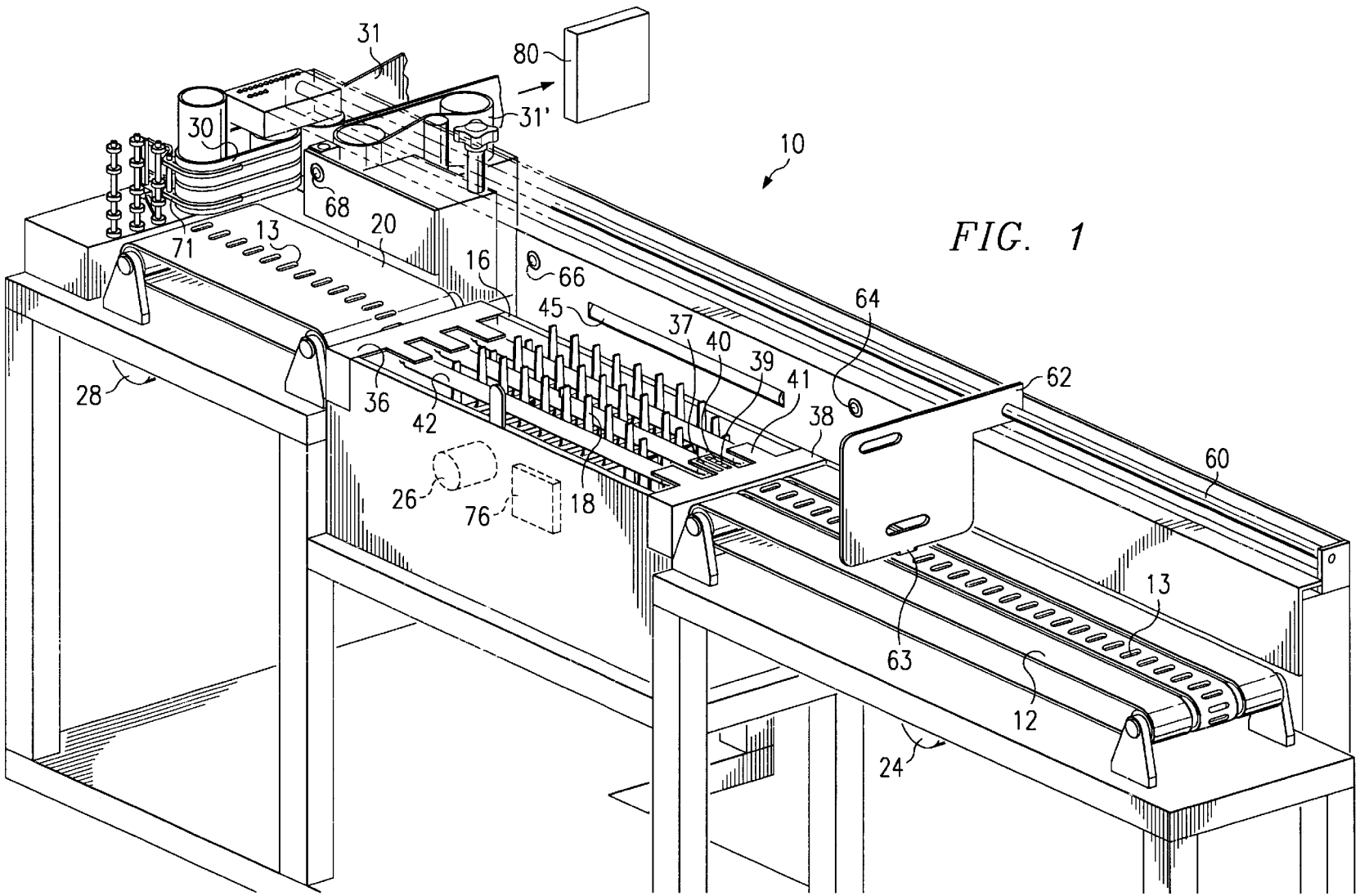
FIG. 1 is a perspective view of a mail feeder in accordance with the invention.

While the invention is described below with reference to one or more preferred embodiments, the description is not intended to be construed in a limiting sense. Various rearrangements of parts, modifications and combinations of the illustrative embodiments, as well as other embodiments of the invention, will be apparent to persons skilled in the art upon reference to the description.

Referring to FIGS. 1–4, a feeder system 10 for implementing the method of the invention includes an entry or staging conveyor 12 where an operator loads a stack 14 (FIG. 3) of flat articles, such as mail pieces, for feeding to a sorting or similar processing machine, such as the DBCS sorting device referred to above. Preferably, staging conveyor 12 is a horizontal belt-type conveyor, including a plurality of spaced apart perforations or holes 13 running centrally along the length of the belt. Staging conveyor feeds stacked mail pieces to a horizontal jogger type conveyor 16 including a plurality of fingers 18. Jogger 16 in turn feeds the stack of mail pieces to a horizontal feeder conveyor 20 which, similar to staging conveyor 12, is a belt type conveyor including spaced apart perforations or holes 13 spaced along the length of the belt. Staging conveyor 12, jogger 16 and feed conveyor 20 are each individually driven with motors 24, 26 and 28, each using a conventional belt or chain drive (not shown). Feeder 10 is also provided with covers 38, 36 that span the gaps between jogger 16 and staging conveyor 12 and feed conveyor 20 and jogger 16 to prevent mail pieces from falling between the conveyors.

Figure 2:
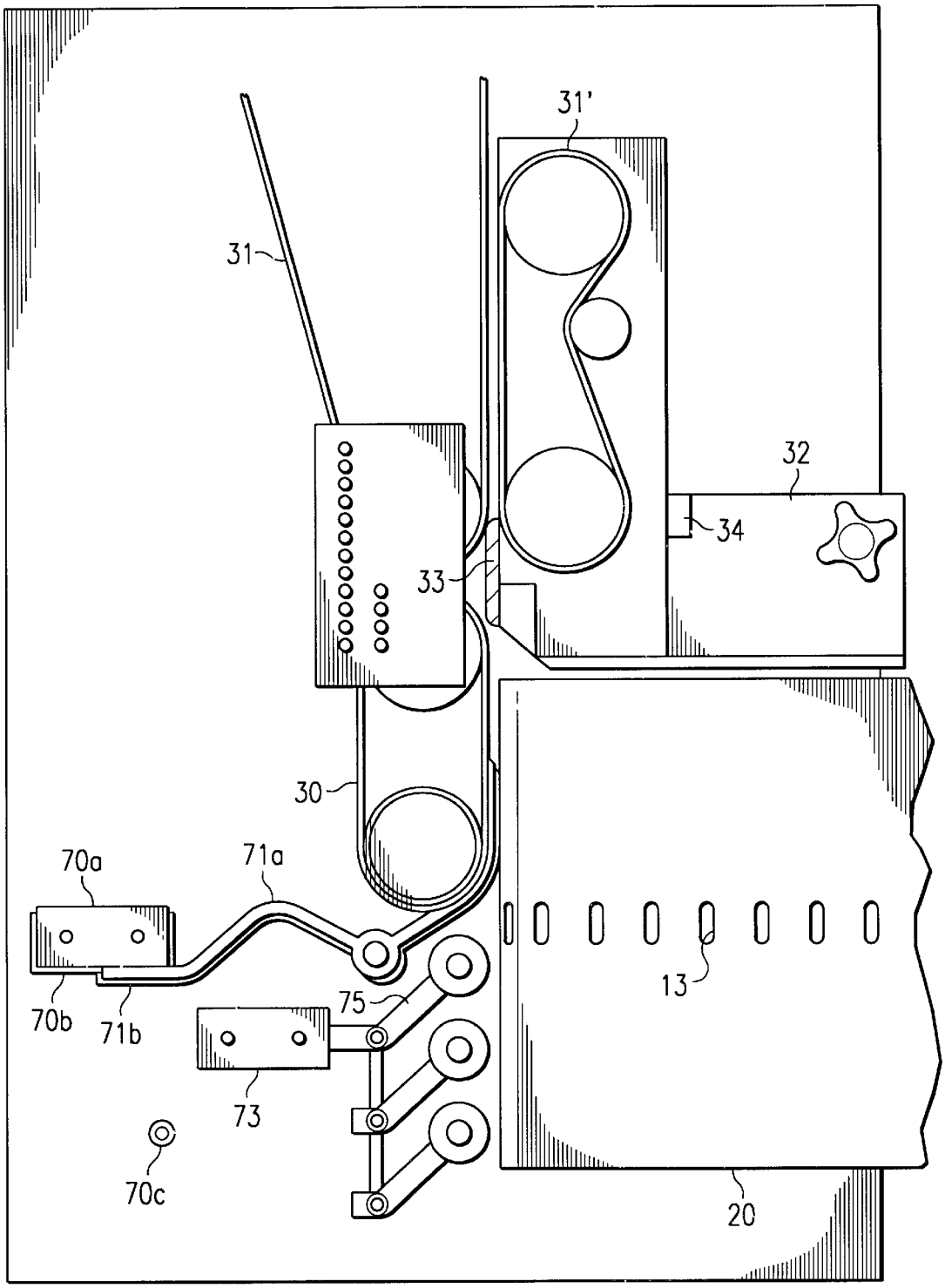
FIG. 2 is partial top view of the feeder of FIG. 1.

In operation, feed conveyor 20 advances the stack 14 of flat articles as an upright takeoff conveyor 30 pulls articles from the stack on a one-by-one basis and feeds the flat articles to a second set of upright, opposed belt conveyors 31, 31'. Preferably, takeoff conveyor 30 is a perforated belt type conveyor wherein a vacuum is applied through the perforations to hold flat articles against the belt. As best shown in FIG. 2, takeoff conveyor 30 is mounted perpendicular to feed conveyor 20 for receiving a flat side of articles advanced against the belt by feeder conveyor 16. A spring loaded slide 32, biased toward conveyor 31, is positioned next to take off conveyor 30 guides and includes a guide 33 that holds mail pieces against conveyors 30 and 31 as the mail pieces are conveyed from the feeder. Guide 33 is preferably formed from a plastic material having a higher coefficient of friction than take off conveyor 30. Thus, if a pair of flat articles double up or overlap as the articles are picked off of stack 14 by take off conveyor 30, guide 33 will retard the overlapping article, while the article abutting take off conveyor 30 is advanced, separating the overlapping articles. After the article in contact with take off conveyor 30 is moved past the overlapping article, the overlapping article is then advanced. Slide 32 is moveable between a closed, engaged position with guide 33 positioned against take off conveyor 30, an open, non-engaged position in which guide 33 is retracted from take off conveyor 30. Slide 32 includes a micro switch 34 which de-energizes feeder 10 when the slide is in the open position. Since slide 32 is spring loaded, when engaged with guide 33 positioned against conveyors 30 and 31, the slide may move a limited distance away from take off conveyor 30 to accommodate the passage of thick articles conveyed by the take off conveyor.

Turning to FIGS. 1, and 5–7, jogger 16 conveys flat articles from staging conveyor 12 to feed conveyor 20 with a plurality of fingers 18 mounted on finger brackets 19 that engage stack 14 at the transition from the staging conveyor 12, carry the stack along length of jogger 16 and disengage from the stack as it approaches the feed conveyor 20. As shown, each bracket carries a row of three fingers mounted in spaced apart relationship on the bracket. It will be appreciated that a row of fingers 18 may be integrally formed with a bracket 19 by means of, for example, injection molding of an appropriate plastic or similar material. Fingers 18 move between and along a plurality of rotating shafts 42 that contact the bottom of stack 14 and are driven in clockwise direction as viewed from staging conveyor 12. Each of shafts 42 includes at least one flattened surface 43 that provides a bouncing or jostling movement to the stack 14 as the stack is conveyed along the length of jogger 16.

Figure 5:
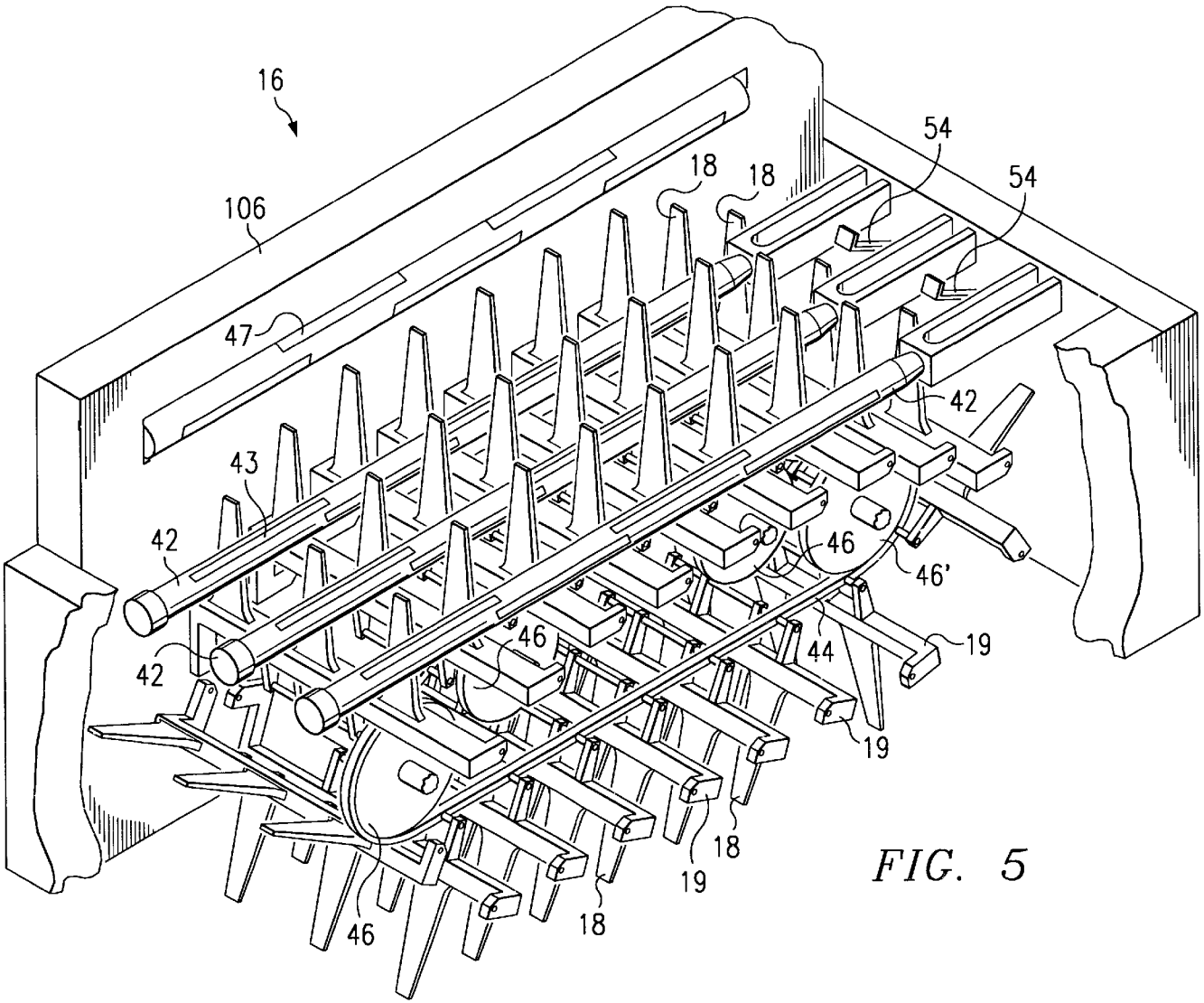
FIG. 5 is a partial cut away perspective view of a jogger suitable for use in a feeder in accordance with the invention.
Figure 6:
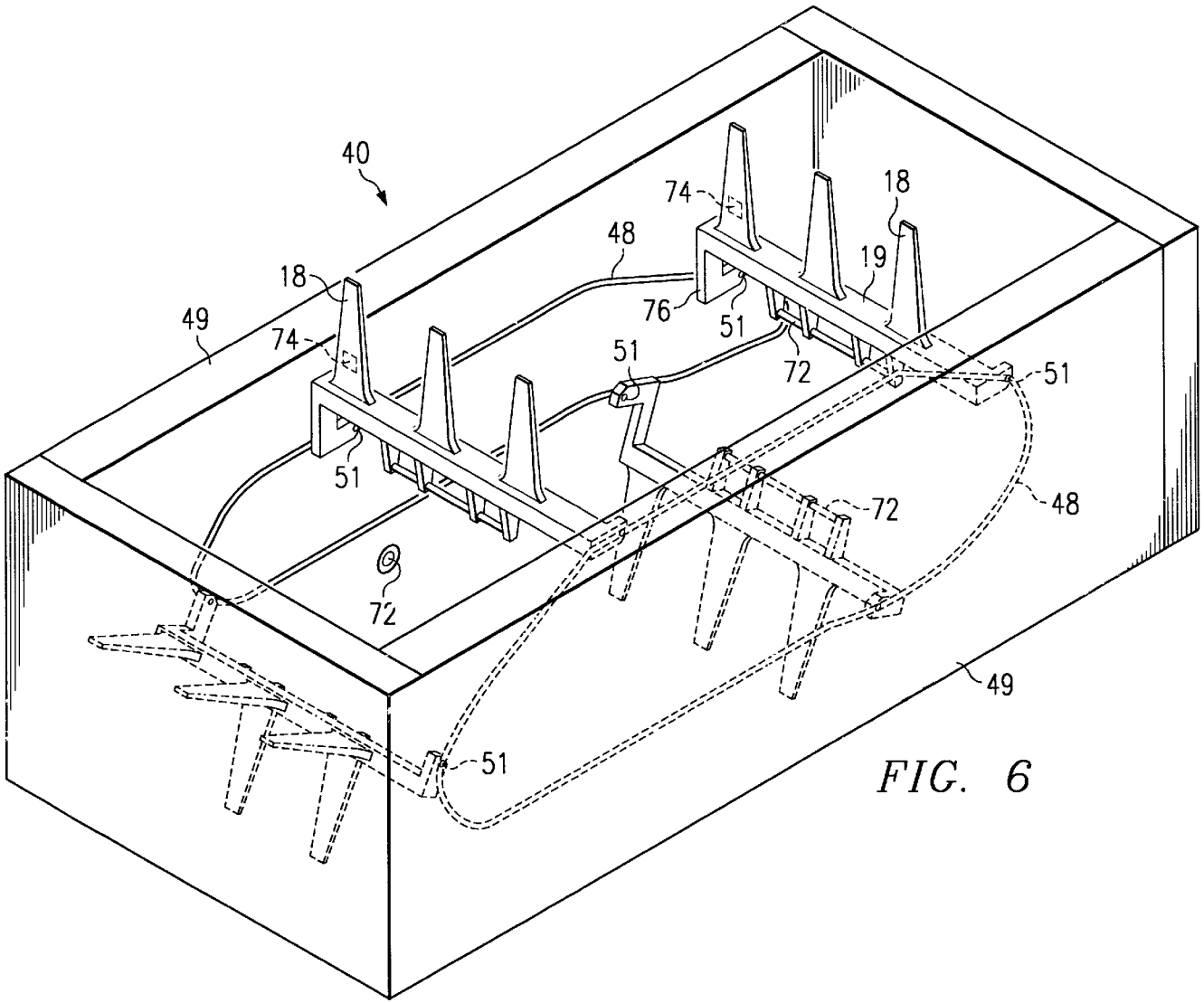
FIG. 6 is partial perspective view of the jogger of FIG. 5.
Figure 7:
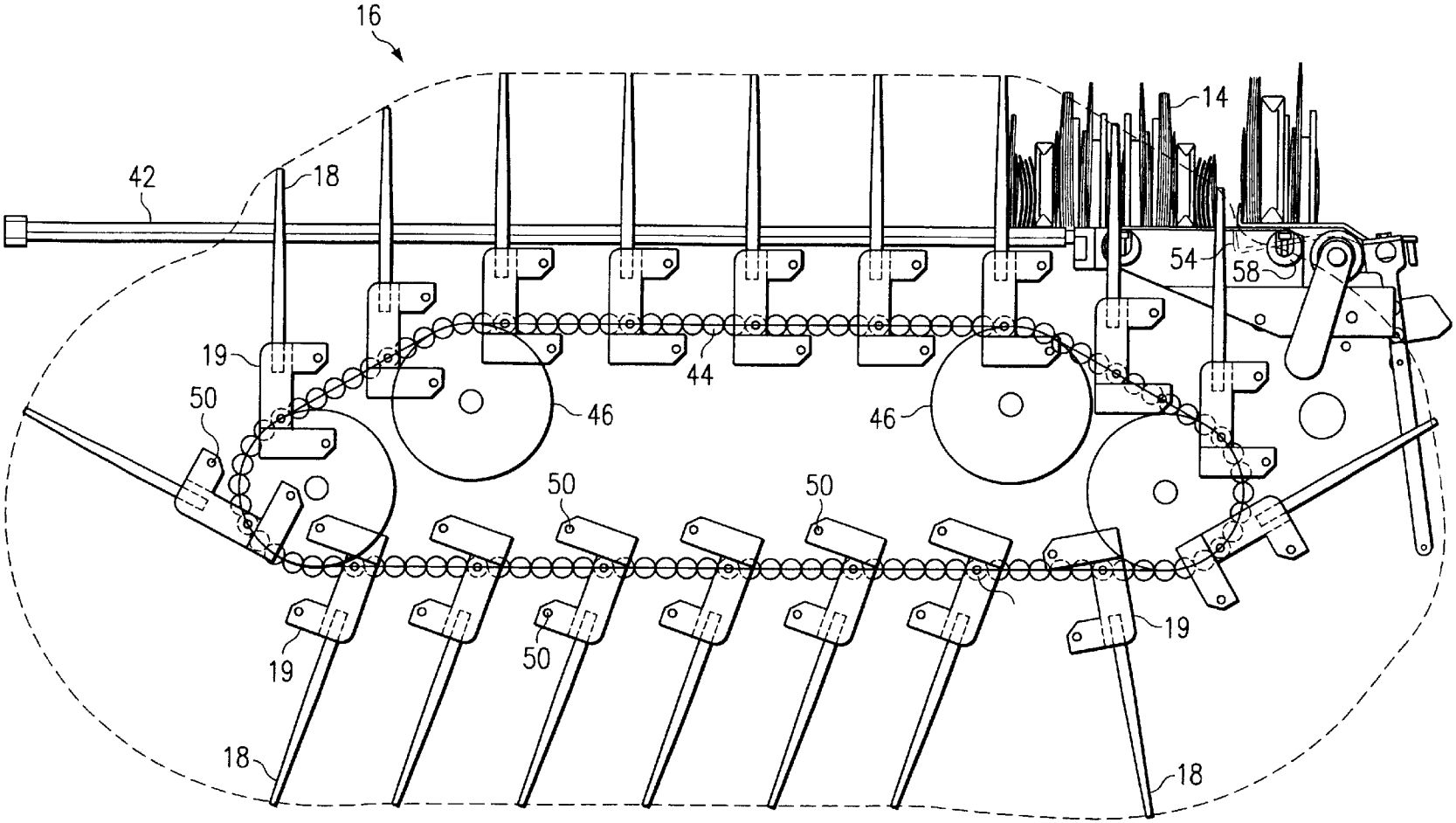
FIG. 7 is a partial side view of the jogger of FIG. 5.

As best shown in FIGS. 5–7, brackets 19 are mounted on and carried by one or more chains 44 passing around a plurality of sprockets 46 in conjunction with guide slots 48 formed in sidewalls 49 of jogger 16. As chains 44 carry brackets 19 and fingers 18, guide pins 51 carried by brackets 19 engage guide slots 48, guiding the fingers 18 through an elongated closed path. As the chain passes over sprocket 46' at the entry end of jogger 16, fingers 18 are carried upwardly between shafts 42 to engage the stack 14 of mail pieces. As shafts 42 rotate, the flat sections 43 of the shaft impart a small jostling or bouncing motion to mail pieces and urge the mail pieces against wall 49 as the fingers carry the mail pieces along the jogger 16. It will be appreciated that the same bouncing or jostling effect may be imparted with an eccentrically formed shaft. An additional edging shaft 45, also having at least one flattened surface 47, is mounted in the back wall 52 of jogger 16. Shaft 45 rotates counterclockwise as viewed from staging conveyor 12 to urge mail pieces fed by jogger 16 down against shafts 42 as the mail pieces travel along the jogger. In addition to edging the mail, the bouncing action provided by flattened surfaces 43 and 47 of shafts 42 and 45 tends to separate the mail pieces and cause any mail pieces that are held in an elevated position by pressure from abutting mail pieces to move down so that the bottom edge of such mail pieces are aligned with the rest of the stack of mail being carried by jogger 16.

Referring to FIGS. 1, 5, 7 and 7A in order to allow jogger 16 to engage and smoothly separate stack 14 into increments corresponding to the distance between fingers 18, a cover 38 is positioned between staging conveyor 12 and jogger 16. Cover 38 includes a plurality of extensions 41 separated by a first set of slots 37 through which fingers 18 rise up into stack 14. Timing belts 39 are positioned in a second slot 40 in one or more of extensions 41 and urge stack 14 across the cover 38, facilitating the transfer of the stack onto the jogger. As fingers 18 are advanced, jogger motor 26 simultaneously drives a cam 58 connected to a set of stack separating fingers 54. As motor 26 advances the jogger, cam 58 drives stack separating fingers 54 upward, lifting the fingers 54 upwardly in slots 37 in cover 38 to engage the bottom of mail stack 14 (FIG. 6). Separating fingers 54 slip between adjacent mail pieces and hold back the bottom edges of mail pieces behind the separating fingers creating a temporary gap. Timing belts 39 aid in the process, urging the bottom of the stack 14 forward as fingers 54 are lifted by cam 58 to create the temporary separation in stack 14. As jogger 16 advances, a set of fingers 18 rise up into the temporary gap, sliding into stack 14 without lifting mail pieces out of the stack. After fingers 18 have engaged the stack, cam 58 lowers separating fingers 54, releasing the stack and allowing it to continue to advance.

Referring again to FIGS. 1–4, a paddle rail 60 is positioned adjacent to and extending along conveyor 12, jogger 16 and feed conveyor 20 for mounting one or more slidable paddles 62. Paddle 62 is configured slide on rail 60 along feeder 10 immediately above conveyors 12, 16 and 20. In operation, the operator positions paddle 62 to engage a tab 63 extending downwardly from the bottom edge of paddle 62 with a hole 13 in one of belt conveyors 12, 16 so that the paddle is pulled by the conveyor along rail 60 as the conveyor advances. To engage paddle 62 with jogger 16, the operator positions the paddle between adjacent sets of fingers 18. In this manner paddle 62 may be carried by conveyors 12 and 20 or jogger 16 in a manner so as to hold a stack of mail pieces together as the stack travels along feeder 10.

Feeder system 10 includes a staging paddle sensor 64, a jogger paddle sensor 66 and an end position sensor 68 for detecting the presence of the paddle at various locations along feeder 10. Feeder system 10 also includes a jogger finger sensor 72 which detects a finger 18 of jogger 16 as it passes the sensor. Feeder 10 further includes "feeder empty" switches 70*a*, 70*b*, 70*c* and 73 for detecting the absence of mail pieces on the feeder. Sensors 64–70*a*, 70*b*, 72 and 73 may be proximity sensors, pressure sensors, micro switches, optical sensors or similar known devices or a combination thereof, depending upon the particular design and application. For example, as illustrated in FIG. 6, each of fingers 18 may be equipped with a permanent magnet 74 and finger sensor 72 may be a magnetic proximity switch that registers each time a finger passes the sensor. In one embodiment, sensor 70*c* (FIG. 10) comprises an optical sensor positioned to scan in the direction of jogger 16 to detect the first mail piece in a stack of mail pieces. Output signals from sensors 64–70*a*, 70*b*, 70*c*, 72 and 73 along with slide switch 34 are fed to a control unit 76 that controls the operation of motors 24–28 and take off conveyor 30 as set forth below. Control unit 76 may be a microprocessor including preprogrammed instructions or a board with hardwired control logic for controlling the operation of feeder 10.

Figure 3:
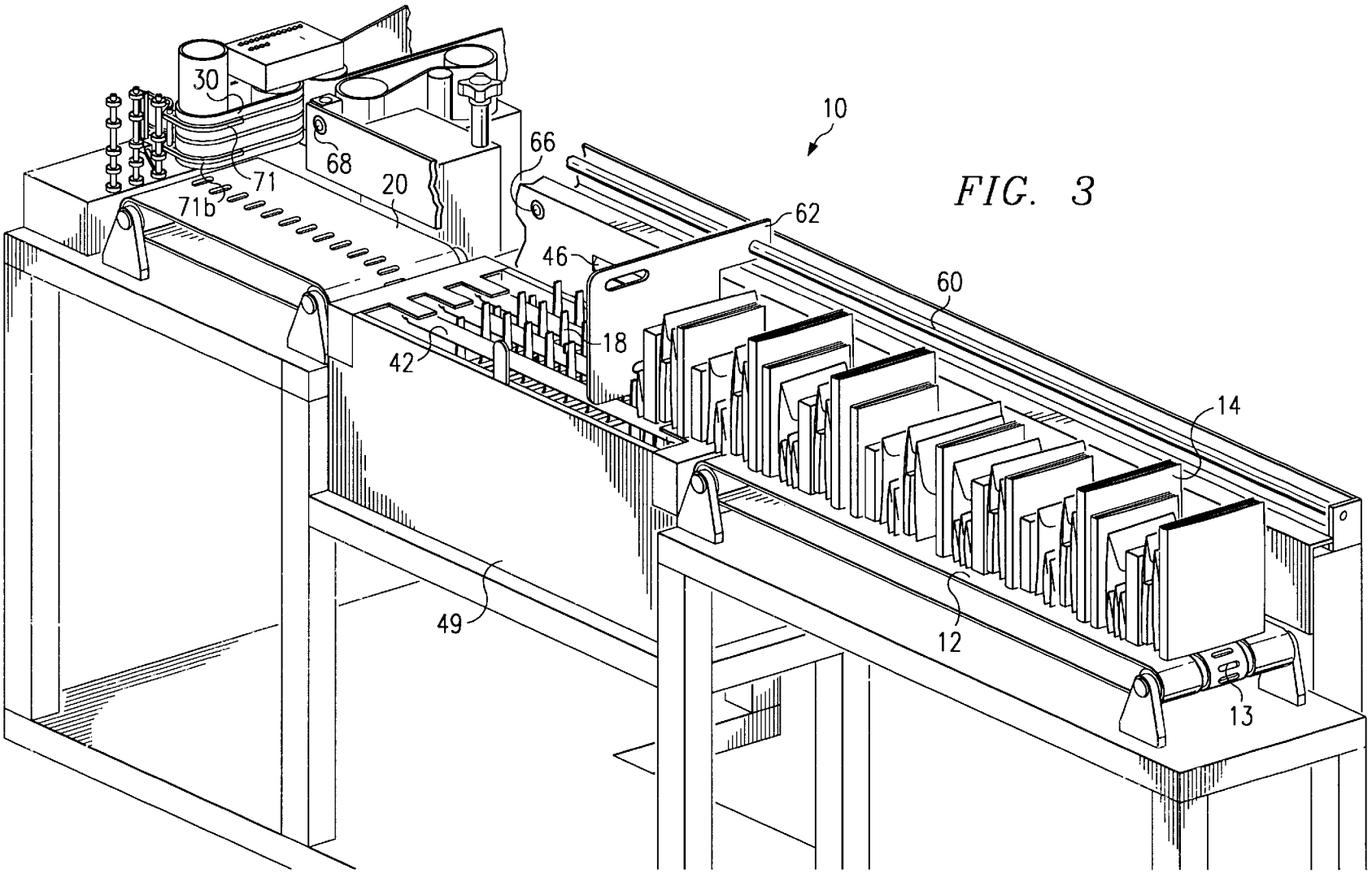
FIG. 3 is a second side view of the feeder of FIG. 1 illustrating the process of loading the feeder.
Figure 8:
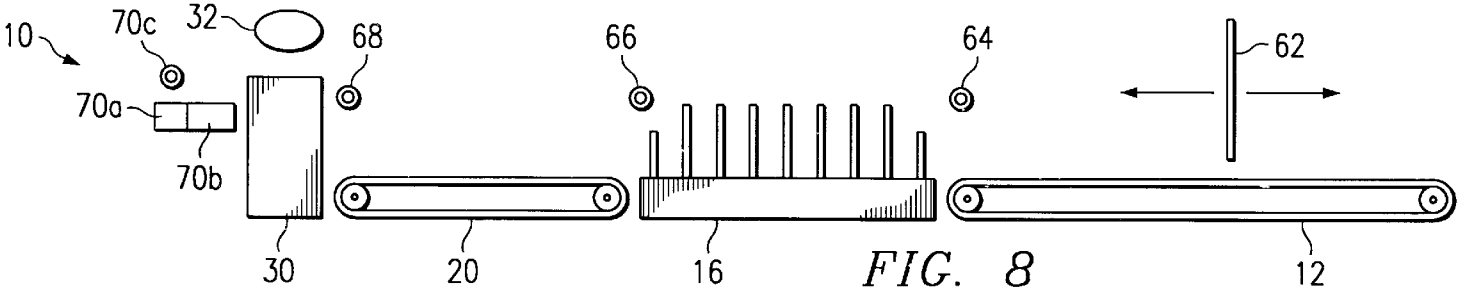
FIGS. 8–10 are schematic representations of the feeder of FIGS. 1–4 at different stages of operation.
Figure 9:
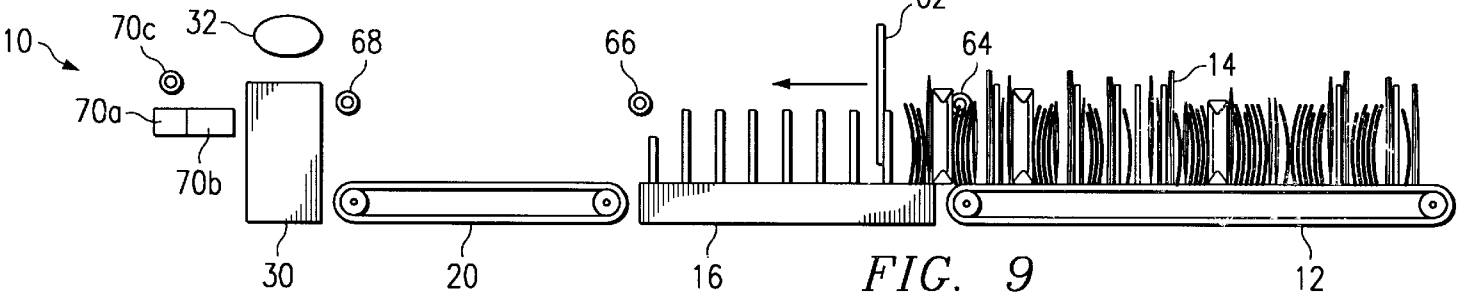

Referring to FIG. 8, feeder 10 is schematically represented in an empty state. To fill feeder 10 with mail pieces, an operator initially opens slide 32 which in turn opens slide switch 34, de-energizing motors 24–28. Feeder system 10, including motors 24–28 and take off conveyor 30 remain de-energized so long as slide switch 34 remains open. After opening slide 32, the operator positions paddle 62 between two adjacent fingers 18 of jogger 16. After positioning paddle 62 between fingers 18, the operator loads staging conveyor 12 with a stack 14 of mail pieces positioned on edge as shown in FIGS. 3 and 9, holding the end of the stack in position manually or with a second paddle (not shown). The operator then closes slide 32, which in turn closes slide switch 34, activating feeder system 10 and starting motors 24–28.

Figure 4:
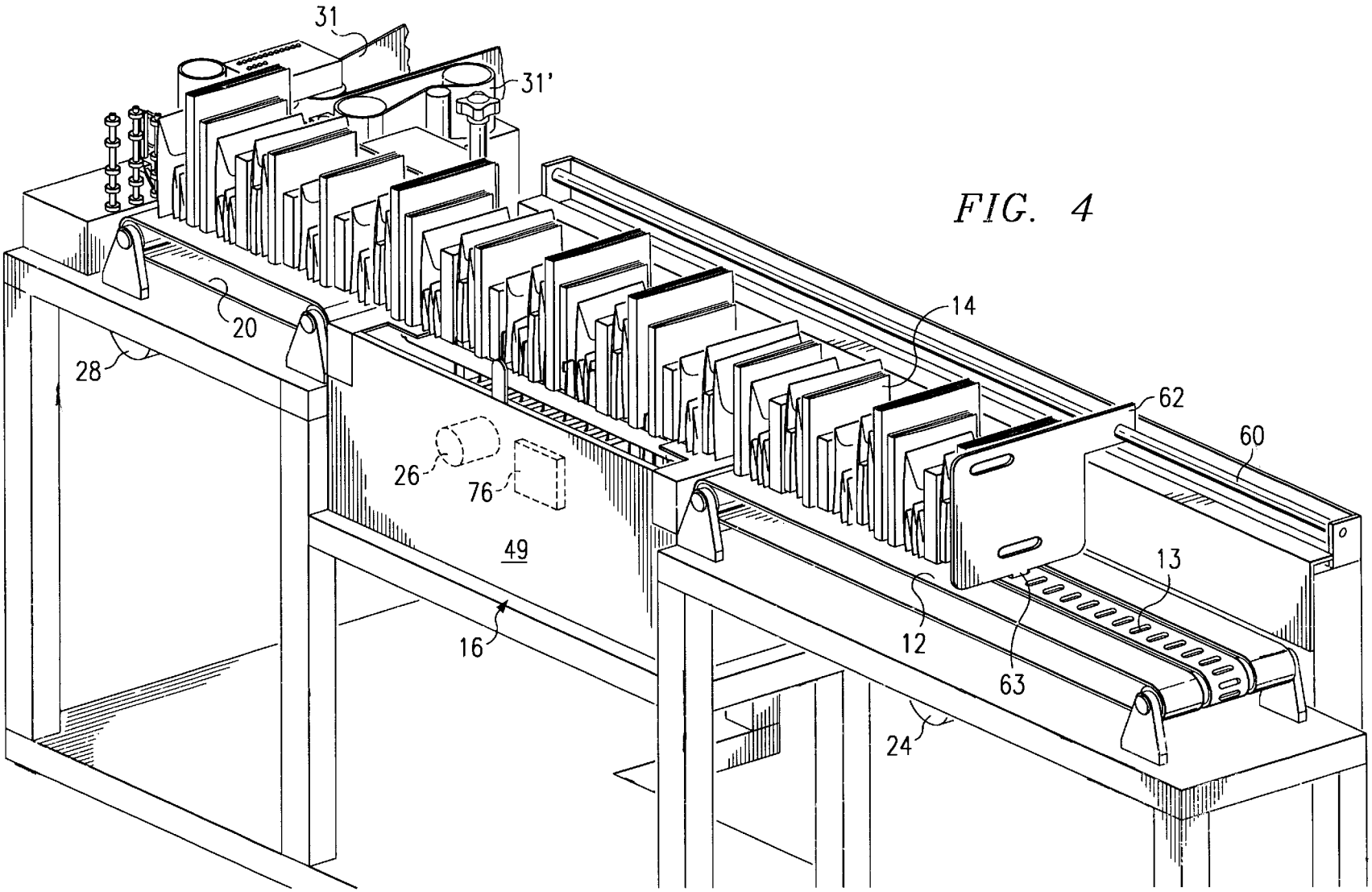
FIG. 4 is a third side view of the feeder of FIG. 1 wherein the feeder is fully loaded and operational.
Figure 10:
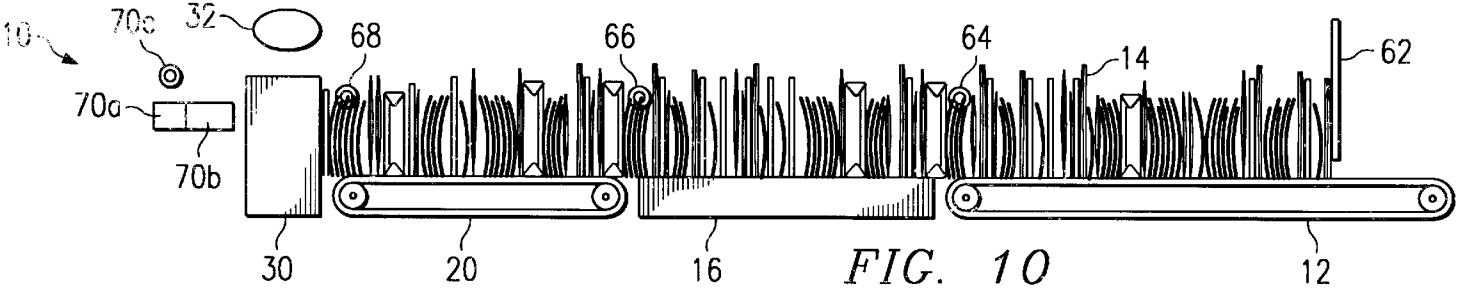

Conveyor 12 and jogger 16 advance the stack 14 to the end of jogger 16 at which time the operator lifts the paddle to clear cover 36, re-engages paddle 62 with feed conveyor 20. When feeder conveyor advances the paddle to a position adjacent to end position sensor 68 the operator opens slide 32, which deactivates or shuts down feeder system 10, including motors 24–28 and take off conveyor 30. The operator then refills staging belt 12 with additional mail and positions paddle 62 to the end of mail stack 14 as illustrated in FIGS. 4 and 10. The operator then starts feeder 10 by closing slide 32, after which feed conveyor 20 advances the mail stack 14 to take off conveyor 30. Feeder 10 then switches to a normal operating mode in which conveyor 30 conveys mail pieces from stack 14 on a one-by-one basis to form a singulated stream of mail pieces suitable for input to a downstream processing device such as an automated mail sorting machine 80 (FIG. 1). In the normal mode, feeder 10 operates automatically, without operator intervention, until it becomes necessary to re-fill staging conveyor 12 with additional mail as described below.

During the feeder fill process, controller 76 operates in a prime mode. In the prime mode, motors 24–28 will not stop if staging paddle sensor 64 or jogger paddle sensor 66 senses paddle 62, allowing feeder 10 to fill without stopping. During the fill process, the operator must lift paddle 62 as required to clear covers 36 and 38 and reposition the paddle is conveyed by staging conveyor 12 to jogger 16 and then to feed conveyor 20. In the prime mode, staging belt 12 is advanced in small increments to allow jogger 16 and feed conveyor 20 to smoothly fill with mail pieces. At the end of the fill process, when end position sensor 68 detects the presence of paddle 62, controller 76 switches from the prime mode to its normal mode.

In the normal mode, feed conveyor 20 is dynamically controlled with feeder empty switches 70*a* and 70*b* which are spring loaded micro switches with arms 71*a*, 71*b* extending through longitudinal slots in take off conveyor 30. When arms 71*a* and 71*b* are depressed by stack 14, closing switches 70*a* and 70*b*, motor 28 that drives feed conveyor 20 is deactivated. If the foremost mail piece in the stack is tilted so as to depress only one of arms 71*a*, 71*b*, the conveyor continues to advance, forcing the mail piece into an upright position such that both arms 71*a*, 71*b* are depressed. This feature prevents take off conveyor 30 from conveying a mail piece from the stack in a misaligned orientation which could result in jamming the feeder. Alternatively, if a back up switch 73 is depressed, feeder conveyor 20 is deactivated. Back up empty switch 73 includes a spring loaded arm 75 and provides a functional redundancy to switches 70*a*, 70*b*. If a mail piece in a stack is too small or positioned too far to the outside of stack 14 to engage and depress arms 71*a*, 71*b*, it will depress switch 73, deactivating feed conveyor 20.

As mail pieces are removed from stack 14, allowing either arm 71*a*, 71*b* or 75 of switches 70*a*, 70*b* and 73, respectively, to extend, motor 28 is activated, driving feed conveyor 20 until the arms are again depressed by the stack 14. Switches 70*a*, 70*b*, 70*c* and 73 also control take off conveyor 30, and in particular, optical sensor 70*c* which detects the absence of mail pieces on conveyor 30, deactivating the conveyor when feed conveyor 20 is empty. Thus, in the normal mode, operation, feed conveyor 20 feeds stack 14 of mail pieces to take off conveyor 30 which removes the mail pieces from the stack on a one-by-one basis, producing a singulated stream of mail pieces that are directed to a mail sorting machine 80 for scanning and sorting into individual bins based upon the scanned information.

In order to maximize the throughput of feeder system 10 as a stack comprising a random mix of thick and thin mail pieces is singulated and conveyed by the feeder, feed conveyor 20 is dynamically controlled to operate in a rapid cyclic manner. In order to provide such a rapid cyclic or incremental operation, motor 28 is equipped with an internal or external clock that registers rotation of the motor with "ticks," each corresponding to a whole or fractional rotation of the motor. Motor 28 advances feed conveyor 20 in increments corresponding to these "ticks" whenever empty sensor or switches 70*a–b* indicates that no mail piece is positioned against take off conveyor 30. If arms 71*a–b* of switches 70*a–b* are not depressed by a mail piece, motor 28 is energized to advance one "tick." If arm 71 is still not depressed, motor 28 is again energized to advance another "tick." Motor 28 cycles in this manner until arms 71*a–b* are depressed, indicating that the foremost mail piece is in sufficient engagement with take off conveyer 30 to be conveyed.

In order to facilitate this rapid cyclic on-off operation while simultaneously maintaining a throughput approximating the capacity of jogger 16, feed conveyor 20 is configured so as to be operated at a faster rate than jogger 16, for example at a maximum linear velocity two to six times greater than jogger 16. In a preferred embodiment, feed conveyor 20 advances at a linear velocity four times faster than jogger 16.

Dynamic control and incremental or cyclic operation of feed conveyor 20 with empty sensors or switches 70*a*, 70*b* and 73 allows the conveyor to advance at a rate proportional to the rate at which take off conveyor 30 is removing mail pieces from stack 14, irrespective of whether relatively thick or thin articles are conveyed at a given moment. As used herein the term "thin" is used to characterize flat articles or mail pieces having a thickness corresponding to a typical letter or even a post card having a thickness of 1/16 inch or less. Alternatively, "thick" flat articles or mail pieces may comprise packaged catalogs or similar items having a thickness from 1/16 inch up to ½ inch. As will be appreciated, on a volume basis, a stack of thick articles can be processed through a singulator such as feeder 10 more rapidly than a stack of thin articles. Thus, when a stack of mixed thin and thick articles are processed through a conventional feeder, the feeder must be operated at a rate low enough to process a stack comprising only thin articles. However, in a method and apparatus according to the invention, dynamic control of the feed conveyor allows feeding of a stack of mail pieces or flat articles comprising both thick and thin articles at a variable rate, allowing a high rate of throughput.

For example, when one or more thick mail pieces are removed from feed conveyor 20 leaving a temporary gap in stack 14, sensors 70*a*, 70 or 73 will cause motor 28 to rapidly increment the feed conveyor until the next mail piece in stack 14 is positioned against empty switches 70*a*, 70*b* or 73. Alternatively, when take off conveyor 30 removes a series of thin mail pieces, such as letters, postcards or single sheet forms from feed conveyor 20, the conveyor will advance only when a sufficient number of the thin mail pieces have been removed to release one of switches 70*a*, 70*b* or 73, which in turn causes conveyor 16 to incrementally advance. As will be appreciated, dynamic control of feed conveyor 20 thus provides for greater throughput as opposed to a single, or constant speed control, that would necessarily be set to operate at a rate low enough to accommodate a stack 14 comprising only thin mail pieces.

In order to keep feed conveyor full, jogger 16 is controlled to advance stack 14 at a rate proportional to the rate at which take off conveyor 30 removes mail pieces from the feeder conveyor. To accomplish this task, each tick of take off conveyor motor 28 is registered with or counted by controller 76. After a predetermined number of ticks, controller 76 activates jogger motor 26, advancing fingers 18 and feeding additional mail onto feed conveyor 20. Jogger motor 26 remains activated until finger sensor 72 detects a jogger finger 18 adjacent to sensor 72 and signals controller 76 that de-energizes jogger motor 26. As will be appreciated, during this process jogger 16 is advanced a distance corresponding to the gap or spacing between fingers 18, for example 2–3 inches which defines an incremental volume of mail pieces. This incremental volume of mail pieces corresponds to the predetermined number of ticks advanced by motor 28 and registered by controller 76 in order to activate jogger 16.

In the normal mode, motor 24 that drives staging conveyor 12 is also controlled with feeder empty switches 70*a*, 70*b*, 70*c* and 73, advancing staging conveyor 12 as mail pieces are removed from feed conveyor 20 with take off conveyor 30. To insure that the correct volume of mail pieces needed to fill the space between two adjacent sets of jogger fingers 18, staging conveyor motor 24 is also equipped with an internal or external clock as described above in connection with take off conveyor motor 28. The movement of staging conveyor 12 is controlled by registering the number of ticks advanced by staging conveyor motor 24. When motor 24 has advanced a predetermined number of ticks corresponding to the distance between a pair of adjacent jogger fingers 18, controller 76 deactivates the motor.

As staging conveyor 12 advances and stack 14 is depleted, staging conveyor 12 carries paddle 62 until the paddle activates staging paddle sensor 64. When sensor 64 detects paddle 62, the sensor signals controller 76 to deactivate motors 24–28 and take off conveyor 30, shutting down feeder 10 until an operator reloads staging conveyor 12 with additional mail pieces and repositions the paddle behind the newly added stack of mail pieces, after which feeder 10 resumes operation in its normal mode. Staging sensor 64 may also activate an audio alarm or other signaling system to alert the operator that the staging conveyor 12 is empty.

In order to empty feeder 10, the feeder is operated until paddle 62 activates staging paddle sensor 64, deactivating feeder 10. The operator lifts paddle 62 allowing the feeder to restart and places the paddle between two adjacent jogger fingers 18. When jogger 16 has advanced paddle 62 sufficiently to activate jogger paddle sensor 66, controller 76 again deactivates feeder 10 until the operator lifts the paddle, allowing feeder 10 to restart, and lowers the paddle onto feed conveyor 20, engaging the conveyor with the paddle. When paddle 62 reaches end position sensor 68, controller 76 deactivates motors 24–28. When the last mail piece has been removed from feed conveyor 20, optical empty switch 70*c* signals an empty condition to controller 76 which then deactivates take off conveyor 30.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A feeder for a mail sorter, comprising:

a horizontal entry belt conveyor:

a jogger which receives a stack of mail from the entry conveyor on edge and aligns the stack as it passes through the jogger;

a horizontal feeder belt conveyor that receives the stack in increments from the jogger;

an upright take off mechanism at an end of the feeder conveyor opposite the jogger that removes a frontmost mail piece from the stack sideways and feeds it to the mail sorter;

a repositionable paddle mounted on a rail above the conveyors and jogger for supporting a rear end of the stack of mail pieces as it moves through the feeder;

a sensor positioned to determine when a frontmost mail piece is in sufficient engagement with the take off mechanism for the take off mechanism to remove the frontmost mail piece; and a controller that counts each incremental advance of the feeder conveyor and incrementally advances the jogger to feed additional mail pieces onto the feeder conveyor when a predetermined number of incremental advances of the feeder conveyor has occurred.

2. The feeder of claim 1 wherein the take off mechanism comprises a vertical belt type conveyor.

3. The feeder of claim 1 further comprising a jogger sensor for detecting an incremental movement of the jogger.

4. The feeder of claim 1 wherein the controller advances the entry conveyor when a predetermined number of incremental advances of the feeder conveyer has occurred.

5. The feeder of claim 1 further comprising a plurality of sensors for detecting the position of the paddle and signaling the controller when the paddle is detected.

6. The feeder of claim 1 further comprising a feeder conveyor motor for driving the feeder and wherein the feeder conveyor motor advanced an incremental distance each time the sensor detects that a frontmost mail piece is not in sufficient engagement with the take off mechanism for the take off mechanism to remove the frontmost mail piece from the stack.

7. The feeder of claim 1 wherein the feeder conveyor is configured so as to be operated at a maximum linear velocity two to six times greater than the jogger.

8. A feeder for feeding flat articles, comprising:

a take off device for conveying flat articles from a stack of flat articles advance on edge against the take off device;

a feeder conveyor for conveying a stack of flat articles positioned on edge to the take off device;

a sensor for determining whether a foremost flat article in the stack is positioned to be conveyed by the take off device;

a motor for advancing the feeder conveyor an incremental amount when the sensor fails to detect a flat article positioned for conveying by the take off device;

a jogger for feeding the stack of flat articles to the feeder conveyor; the jogger comprising a plurality of fingers between which the flat articles are received; and a controller that counts each incremental advance of the feed conveyor and incrementally advances the jogger to feed additional articles into the feeder conveyor when a predetermined number of incremental advances of the feeder conveyor has occurred.

9. The feeder of claim 8 further comprising a entry conveyor for conveying a stack of flat articles positioned on edge to the jogger.

10. The feeder of claim 9 further comprising a controller and wherein the controller advances the entry conveyor each time the feeder conveyor is advanced a predetermined number of increments.

11. A method of singulating and feeding mail pieces, comprising:

(a) sensing whether the foremost mail piece in a stack of mail pieces positioned on edge on a horizontal feeder conveyor is engaged with an upright take off device for conveying from the stack;

(b) advancing the feed conveyor an incremental step to place the first of a series of mail pieces positioned on edge in a position for removal from the feed conveyor each time the sensor fails to detect a mail piece engaged with an upright take off device for conveying from the stack;

(c) counting each incremental advance of the feed conveyor;

(d) incrementally advancing the stack of mail pieces with a jogger driven by a second motor steps to load additional mail pieces on the feed conveyor after the feed conveyor has advanced a predetermined number of increments; and (e) repeating steps (a)–(d) while sequentially removing mail pieces from the feed conveyor on a one-by-one basis with the take off device as the feed conveyor is advanced.

12. The method of claim 11 further comprising advancing the stack of mail pieces with a entry conveyor to load additional mail pieces onto the jogger after the feed conveyor has moved a predetermined number of incremental steps.

13. The method of claim 12 further comprising driving the entry conveyor with a third motor to advance the stack of mail pieces.

14. The method of claim 11 further comprising imparting a bouncing motion to the mail pieces on the jogger to separate and align the mail pieces.

15. The method of claim 11 further comprising sensing the motion of the jogger with a sensor that detects a jogger finger moving into proximity to the sensor and stopping forward movement of the jogger when a finger is sensed in proximity to the sensor.

16. The method of claim 11 further comprising creating a temporary separation in the stack of mail pieces with separating fingers to allow the jogger fingers to be inserted into the stack of mail pieces.

17. The method of claim 12 further comprising carrying the end of the stack of mail pieces along the entry conveyor with a paddle, sensing the paddle as it approaches the jogger and de-activating the feeder when the sensor detects the paddle adjacent to the jogger.

18. The method of claim 17 wherein the paddle is carried by the entry conveyor.

19. The method of claim 11 wherein the stack of mail pieces includes thick and thin mail pieces.

20. A method of singulating and feeding mail pieces to a mail processing apparatus wherein a stack of mail pieces are fed to the mail processing apparatus on a one-by-one basis for processing, comprising:

sensing whether a mail piece is positioned on a feeder conveyor in a position for removal from the feeder conveyor with a take off conveyor;

advancing the feeder conveyor an incremental step with a first motor when no mail piece is detected in a position for removal from the feed conveyor and counting each incremental advance of the feed conveyor; and incrementally advancing the stack of mail pieces with a jogger driven by a second motor after the feed conveyor has moved a predetermined number of incremental steps to load additional mail pieces on the feed conveyor, the jogger imparting a bouncing motion to the stack of mail pieces as the mail pieces are advanced.

21. The method of claim 20 wherein the feeder conveyor is driven at a higher maximum linear velocity than the jogger.

22. The method of claim 21 wherein the stack of mail pieces includes randomly ordered thick and thin mail pieces.

* * * * *